US009144313B2

(12) United States Patent
Slevin et al.

(10) Patent No.: US 9,144,313 B2
(45) Date of Patent: Sep. 29, 2015

(54) SEATING WITH ENHANCED GRIP AND POSTURE CORRECTION

(71) Applicant: Smarter Posture Company Limited, Surrey (GB)

(72) Inventors: Kieran Slevin, Surrey (GB); Uzzel Edward, Surrey (GB)

(73) Assignee: Smarter Posture Company Limited (GB)

( * ) Notice: Subject to any disclaimer, the term of this patent is extended or adjusted under 35 U.S.C. 154(b) by 0 days.

(21) Appl. No.: 14/358,748

(22) PCT Filed: Nov. 19, 2012

(86) PCT No.: PCT/GB2012/000847
§ 371 (c)(1),
(2) Date: May 16, 2014

(87) PCT Pub. No.: WO2013/072656
PCT Pub. Date: May 23, 2013

(65) Prior Publication Data

US 2015/0123438 A1 May 7, 2015

(30) Foreign Application Priority Data

Nov. 17, 2011 (GB) ..... 1119851.2
Oct. 31, 2012 (GB) ..... 1219579.8

(51) Int. Cl.
*A47C 7/02* (2006.01)
*A47D 15/00* (2006.01)

(52) U.S. Cl.
CPC . *A47C 7/02* (2013.01); *A47C 7/021* (2013.01); *A47D 15/006* (2013.01)

(58) Field of Classification Search
CPC ... A47C 7/02; A16H 7/001; A16H 2201/1284
USPC ..... 297/219.1, 219.12; 5/731, 736; 601/27, 601/28, 135, 137, 138, 23; 4/582, 583
See application file for complete search history.

(56) References Cited

U.S. PATENT DOCUMENTS 3,888,241 A * 6/1975 Fischer ..... 601/19
4,383,342 A 5/1983 Forster (Continued)

FOREIGN PATENT DOCUMENTS

DE 1843734 12/1961
DE 2117330 10/1972

(Continued)

OTHER PUBLICATIONS

The International Bureau of WIPO, Geneva Switzerland Notification Concerning Transmittal of International Preliminary Report on Patentability (Chapter 1 of the Patent Cooperation Treaty) (PCT RUle 44bis.1(c)); Date of Mailing: May 30, 2014.

(Continued)

*Primary Examiner* — David R Dunn
*Assistant Examiner* — Timothy J Brindley
(74) *Attorney, Agent, or Firm* — Luedeka Neely Group, PC

(57) ABSTRACT

A seating mat providing enhanced grip and posture correctional features includes an upper surface for supporting a user when seated and an array of flexible papillae extending from the upper surface and positioned around a focus area on the upper surface. Each papilla includes a tapered projection with a curvature such that at the tip end of each projection the longitudinal axis of the projection lies at an acute angle relative to the upper surface. The papillae are positioned such that all the tips are directed towards the focus area. The shape and positioning of the papillae encourage a user to reference themselves centrally on the focus area and tend to grip the user's thighs to prevent slipping.

16 Claims, 5 Drawing Sheets

(56) References Cited

U.S. PATENT DOCUMENTS

| | | | | |
|---|---|---|---|---|
| 4,461,285 | A * | 7/1984 | Courtin | 601/137 |
| 4,945,591 | A | 8/1990 | Inagaki | |
| 5,285,774 | A * | 2/1994 | Stachurski | 601/137 |
| 5,293,660 | A * | 3/1994 | Park | 15/160 |
| 5,402,545 | A | 4/1995 | Jolley | |
| 5,628,079 | A | 5/1997 | Kizemchuk et al. | |
| 6,036,271 | A * | 3/2000 | Wilkinson et al. | 297/452.41 |
| 6,095,091 | A * | 8/2000 | Byrne | 119/712 |
| 6,381,784 | B1 * | 5/2002 | Davis et al. | 5/636 |
| 6,554,782 | B2 * | 4/2003 | Robbins et al. | 601/28 |
| 6,966,088 | B1 * | 11/2005 | Hu | 5/630 |
| D628,303 | S * | 11/2010 | Hsu | D24/213 |
| 8,800,978 | B2 * | 8/2014 | Tarazona De La Asuncion | 267/142 |
| 2001/0040397 | A1 | 11/2001 | Elliott | |
| 2002/0091343 | A1 * | 7/2002 | Chen | 601/136 |
| 2002/0133105 | A1 | 9/2002 | Dabir | |
| 2004/0204665 | A1 | 10/2004 | Chu | |
| 2004/0215114 | A1 * | 10/2004 | Cruz | 601/132 |
| 2005/0044635 | A1 | 3/2005 | O'Reagan | |
| 2005/0076448 | A1 | 4/2005 | O'Reagan | |
| 2014/0088474 | A1 * | 3/2014 | Bukharina et al. | 601/134 |

FOREIGN PATENT DOCUMENTS

| | | | |
|---|---|---|---|
| DE | 29510650 | | 10/1995 |
| EP | 0637423 | A1 | 2/1995 |
| GB | 346911 | | 4/1931 |
| GB | 1240366 | | 7/1971 |
| GB | 1391539 | | 4/1975 |
| JP | 2005288131 | | 10/2005 |
| JP | 314093 | | 4/2008 |
| JP | 314093 | U | 4/2008 |
| WO | 2008096956 | A1 | 8/2008 |
| WO | 2010011401 | A1 | 1/2010 |

OTHER PUBLICATIONS

International Search Report for PCT/GB2012/000847(5 pgs.); date of mailing Sep. 5, 2013.

GB Intellectual Property Office Search Report Under Section 17 for GB1119851.2 dated Jul. 2, 2012 (2 pgs.).

GB Intellectual Property Office Search Report Under Section 17 for GB1119851.2 dated Mar. 16, 2012 (2 pgs.).

GB Intellectual Property Office Search Report Under Section 17 for GB1219579.8 dated Jan. 31, 2013 (2 pgs.).

* cited by examiner

SEATING WITH ENHANCED GRIP AND POSTURE CORRECTION

CROSS-REFERENCE TO RELATED APPLICATION

This application claims priority under all applicable statutes, and is a U.S. National phase (37 U.S.C. Section 371) of International Application PCT/GB2012/000847, filed 19 Nov. 2012, and entitled SEATING WITH ENHANCED GRIP AND POSTURE CORRECTION, which claims priority to GB 1219579.8, filed Oct. 31, 2012, and GB 1119851.2, filed Nov. 17, 2011, incorporated herein by reference in their entireties.

The present invention relates to seating which provides enhanced grip and posture correctional features. The invention may be provided in the form of a mat which can be placed on a pre-existing chair or other seating area, but it may also be integrally formed with a chair or other type of seat.

Chronic back pain is a serious issue in most developed countries where increasingly sedentary lifestyles are prevalent. Long periods spent sitting with an incorrect posture can lead to back pain, and also pain in other areas of the body and other health problems such as poor digestion, inflexibility and reduced range of movement in the joints and weight gain. All of these tend to further contribute to poor posture and a vicious circle results.

When a person stands upright their lower back (lumbar spine) naturally adopts a forward-facing curve (lumbar lordosis). The lordosis is held by the combination of the shape of the vertebrae, spinal ligaments, tendons and muscles. It is a structural curve that can be maintained with minimal muscular activity. It is desirable for the spine to retain this posture when a person sits.

The key to achieving the lumbar lordosis while sitting is to have the seat base angled downwardly toward the front, i.e. so there will be a downward slope towards the person's knees. Medical studies show that a 5 degree angle between the thigh (hip to knee) and the horizontal, with the knee lowermost, is needed to achieve a correct sitting posture. This angle creates a natural lumbar lordosis and allows the back, and its musculature, to be relaxed whilst it is held straight and upright. Specifically in children this will also provide digestive tract benefits through having an upright posture.

Most chairs, ergonomic or otherwise, have seats close to horizontal or even sloping downwardly towards the back. When the thighs are in a horizontal position, the pelvis is rotated backwards, the lumbar spine arches forwards and the lumbar lordosis is lost. This requires the muscles in the back to support the body for an extended period. The only unequivocal information that consistently comes out of research into how people sit is that they rarely adjust their chairs—and in the few cases when they do, it is usually only the height. Traditionally, designers and 'ergonomists' have proposed the use of a lumbar support, however this is merely fighting against the spine, which is being forced to arch forwards as the pelvis rotates backwards.

Best practice requires standing up regularly, which very few people do. Research has also shown that the worst thing for the back is inactivity, so regular small, movements can prove very beneficial thereby aiding the circulation of blood and the healthy function of the whole of the body.

At the base of each ischium bone in the pelvis is a bony bump called the ischial tuberosity. When seated, most of the upper body weight is supported by these two bumps. Chairs can be adjusted to create angled downward slopes, but gravity and poor posture behaviour encourages the sitter to slouch or slide forward & downwards, which then creates muscle stress in the back and thighs, as the muscles are activated and needlessly working to counter support the natural spine position which will then lead to fatigue.

Various types of chairs or cushions for chairs are known which aim to increase comfort and improve posture. For example various wedge-shaped cushions for placing onto a chair are available. However, typically the slope provided by the wedge is too great and the user simply tends to slip forwards and end up sitting on the front edge of the chair. In CN 201039904 a massage anti-skid cushion is provided in the form of a mat with a number of projections on its upper surface. However, these are simply hemispherical or rounded projections and so the user can easily slip about and change position. Thus, none of these are truly effective in dealing with the problem.

U.S. Pat. No. 4,383,342 and JP2005/288131 both describe cushions or mattresses with the plurality of ribs or projections extending from the surface which is intended to come into contact with a user. The ribs or projections each have a straight longitudinal axis extending away from the surface. Some of the ribs or projections are tilted relative to the surface so that their axes are at an angle other than 90 degrees relative to the surface. The mattresses/cushions shown in these documents are intended for a user to lie upon or lean against rather than sit on. When a user is not making contact with the mattress or cushion, the ribs or projections have straight longitudinal axes and when a user makes contact with the mattress or cushion, the projections or ribs may be deformed and provide a tractive effect on the user's spine. However, the projections or ribs do not provide any enhanced grip to prevent the user slipping, nor do they provide any posture correctional effects.

The present invention provides a seating mat comprising an upper surface for supporting a user when seated and an array of flexible papillae extending from the upper surface and positioned around a focus area on the surface, wherein each papilla comprises a tapered projection with a curvature such that at the tip end of each projection the longitudinal axis of the projection lies at an acute angle relative to the upper surface, and wherein the papillae are positioned such that all the tips are directed towards the focus area.

The arrangement of the papillae encourages the user to sit in the correct position and provides constant sensory feedback to train the user to adopt a more correct posture. The papillae have a longitudinal axis which is curved, even when no user is making contact with the seating mat. The tapered and curved papillae grip a user's thigh muscles to prevent slipping.

Preferably, the papillae are arranged in concentric circles around the focus area, which is most effective in directing the user to sit over the focus area.

The array may include papillae of different sizes, for example in the range of 1 mm to 10 mm, and these may be arranged with the smallest papillae closest to the focus area and the size increasing in a direction away from the focus area. Such an arrangement is most effective in directing the user to sit in the appropriate position whilst also being the most comfortable.

The density of the papillae in the array may vary, for example in the range from 1.5 to 5 papillae per $cm^2$. This also improves grip and comfort.

Gaps may be provided in the array of papillae to provide channels for air circulation when a user is seated on the mat, for increased comfort.

Preferably, the seating mat further comprises a raised ridge extending across the array and the focus area. This encourages the user to sit with the ischium to the rear of the ridge for optimum positioning.

Preferably, the seating mat may further comprise a raised plateau extending across the array and the focus area, and this plateau may itself further include a raised ridge extending along it. The plateau slightly raises the pelvis to provide a downward slope from hip to knee. A plurality of cushioning elements may be formed on the raised plateau to increase user comfort.

The seating mat may be a separate item which can be placed on to an existing chair or other seating area, so that a user can take it with them to use in any environment. In this case, the lower surface of the mat may be textured to increase grip. The lower surface may also include projections and/or recesses configured to engage with corresponding recesses and/or projections on the chair or other seating area.

The invention may also take the form of a chair, stool, bench or other seating area integral with the seating mat as described above, so that the seating surface is permanently provided with the beneficial features of the invention.

In a second aspect, the present invention provides a seating mat comprising an upper surface for supporting a user when seated, having opposed front and rear edges and opposed side edges, wherein a raised plateau extends at least partway across the mat between the opposing side edges, closer to the rear edge than the front edge, and further comprising a raised ridge extending along the raised plateau.

The invention will now be described in detail, by way of example only, with reference to the accompanying drawings in which.

The present invention is designed to help a user to adopt the right posture whilst sitting on most rigid or hard surfaced chairs, whatever types and styles, at all times. The features discussed below of angled, tapered papillae, the layout of differing papillae heights, thigh strip and spine riser all address neural messaging by location, feel, stimulus or visual representation. In other words, the seating which the invention provides encourages a user to sit correctly by ensuring the most comfortable position is the correct position. In addition to such direct stimulus, the textured features of the invention continually simulate the user's muscles, providing constant feedback which will educate and train users to take up a correct seating position almost automatically.

Specifically, the present invention provides a seating surface with an array of angled papillae. As noted above, the invention may be provided in the form of a mat which can be placed on a pre-existing chair or other seating area and the following description refers generally to such a mat. However, the features of the invention may also be integrally formed with a chair or other seating area.

Figure 1:
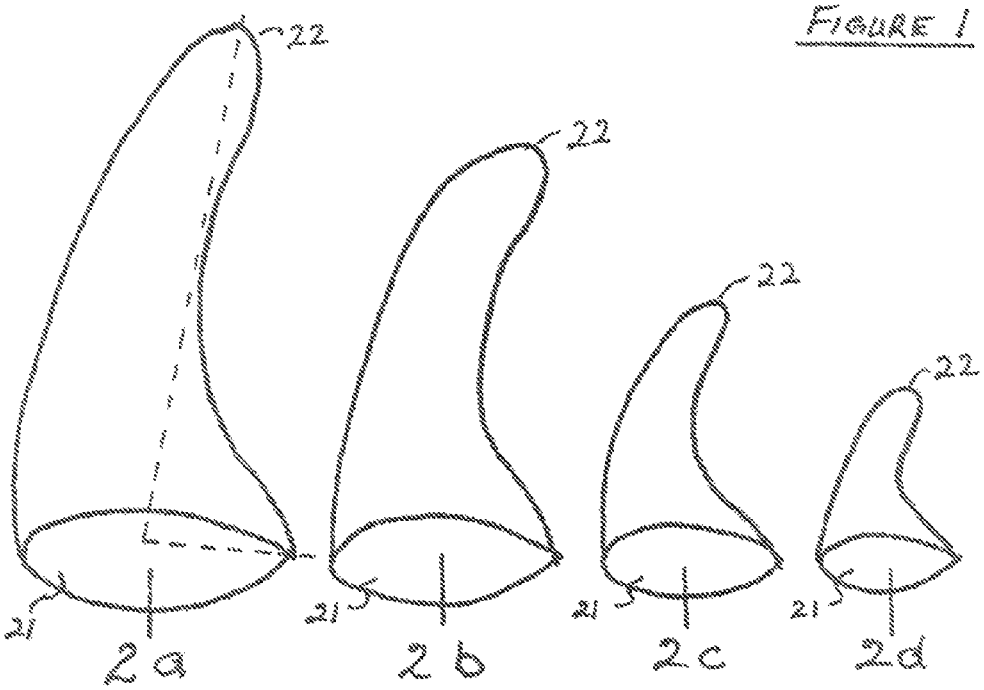
FIG. 1 shows various forms and configurations of papillae as used in the present invention.
Figure 2:
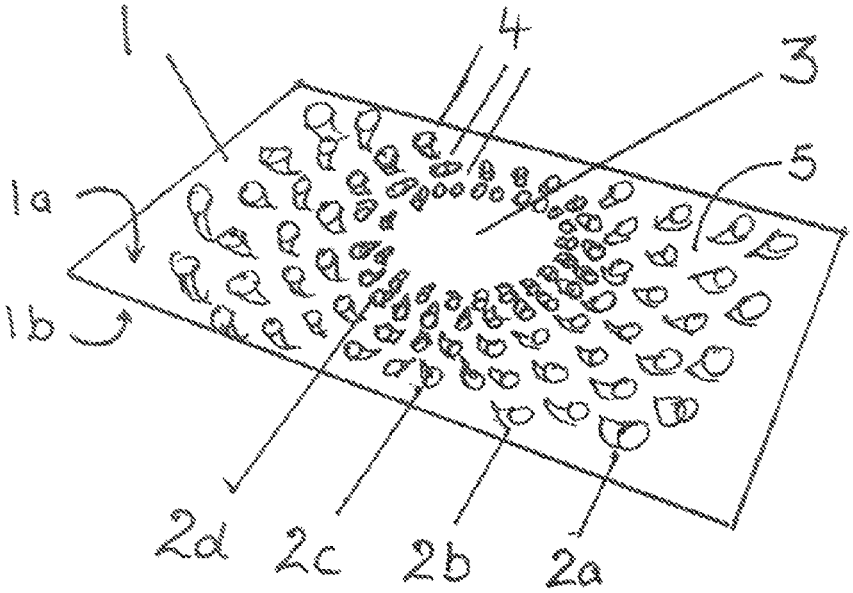
FIG. 2 is a diagrammatic representation of a grip and posture mat with papillae as shown in FIG. 1.

In a first embodiment the invention provides a mat 1 with upper and lower surfaces 1*a*, 1*b* and an array of projections, herein referred to as papillae 2, extending from the upper surface 1*a*, as shown in FIGS. 1 and 2. The mat 1 is preferably an integrally moulded item produced from a polymer material, e.g. rubberised silicon plastics of suitable flexibility and durability.

The papillae 2*a*-2*d* are substantially cone-shaped projections with a round or oval base 21 and a rounded tip 22. The papillae 2 are provided in a range of different heights, for example varying from about 1 mm for the smallest papillae 2*d* to about 10 mm for the tallest papillae 2*a*, although these dimensions can be varied as required. The axis of each papilla 2 has a slight curvature as illustrated in FIG. 1. Thus, at the tip 22, the angle $\alpha$ relative to the upper surface 1*a* of the mat is less than 90°. For the smallest papillae 2*d*, the tip 22 is at the shallowest angle, for example about 15°, and this gradually increases to the largest papillae 2*a* where there may be an angle of about 65°. However, it will be appreciated that these precise angles may be varied. The number of different forms of papillae may also be varied as required and it is not always essential to have four different papillae 2*a*-2*d* as shown.

In the example of FIG. 2, the papillae 2 are arranged in a generally circular array on the mat 1, around a central smooth focus area 3 on the upper surface 1*a*. The papillae 2 are arranged in concentric circles 4 with the smallest papillae 2*d* bounding the focus area 3 and the papillae increasing in size moving radially outwardly from the focus area 3. The precise configuration and the number of circles 4 of each of the different sized papillae 2*a*-2*d* is variable. All the papillae 2 are arranged so that their tips 22 lean inwardly towards the focus area 3.

For a mat 1 intended for a child's seat or highchair, the focus area 3 may have a diameter in the order of 6.5 cm. For an adult seat the focus area 3 may be larger, for example with a diameter in the order of 10 cm. However, these dimensions are variable to suit the application.

The smaller papillae are arranged in the greatest density on the mat, for example with about 5 papillae per $cm^2$. The density gradually decreases so that the larger papillae are provided in a less dense array of for example 1.5 papillae per $cm^2$. Gaps 5 are provided between adjacent rings 4 of papillae 2 and the array of rings 4 may also be divided into sectors by radial gaps (not shown). These provide natural air channels for heat dispersal when a user is sitting on the mat 1.

The shape and positioning of the papillae 2 encourage a user to reference themselves centrally on the focus area 3. The papillae 2 tend to grip the user's thighs to prevent slipping.

The mat 1 is not actively uncomfortable to sit on because the papillae 2 are flexible and have rounded tips. Nevertheless, the shape and angling of the tips 22 encourages the user to sit referencing the focus area 3 and upright by continual stimulation of the user's thigh muscles.

Whilst an array of concentric circles of papillae 2 is illustrated, the papillae 2 could be arranged in a different form around the focus area 3. For example, the papillae 2 could be arranged in a series of blocks around the focus area 3. Within each block, the papillae 2 could be in a regular pattern, such as a square or hexagonal grid pattern, or an irregular or random pattern, as required.

Figure 3:
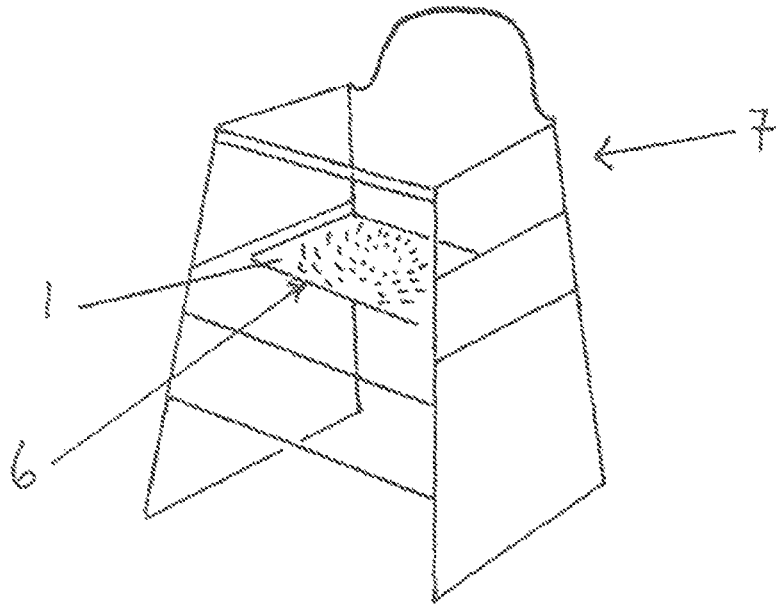
FIG. 3 is a diagrammatic representation of a grip and posture mat on a child's high chair.

FIG. 3 shows the use of the mat 1 on the seat 6 of a child's high chair 7. The mat 1 sits easily on existing high chairs 7 or the mat 1 may be incorporated into the manufacture of the high chairs 7. When a separate mat is used, the natural friction of a mat 1 against the seat may be. enhanced by a textured surface with micro fissures, and/or nodules (not shown) on the base 1*b* of the mat 1. This enhances adhesion of the mat 1 to the seat of a high chair 7 as shown in FIG. 3. Alternatively, the mat 1 may be provided with larger nodules, (not shown) which are accommodated in recesses (not shown) in the seat of the high chair 7 (or a vice versa arrangement) to facilitate secure location, but ease of removal of the mat 1 for cleaning.

Adult versions of the mat 1 will be sized appropriately to suit seating intended for adults.

Figure 4:
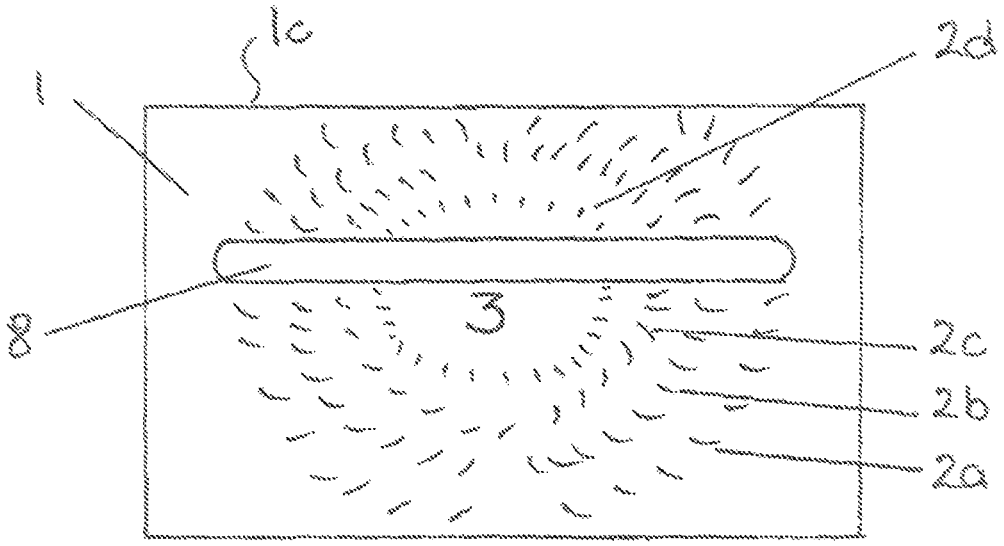
FIG. 4 shows another embodiment of the present invention with a modified layout of the papillae and a posterior thigh strip.
Figure 5:
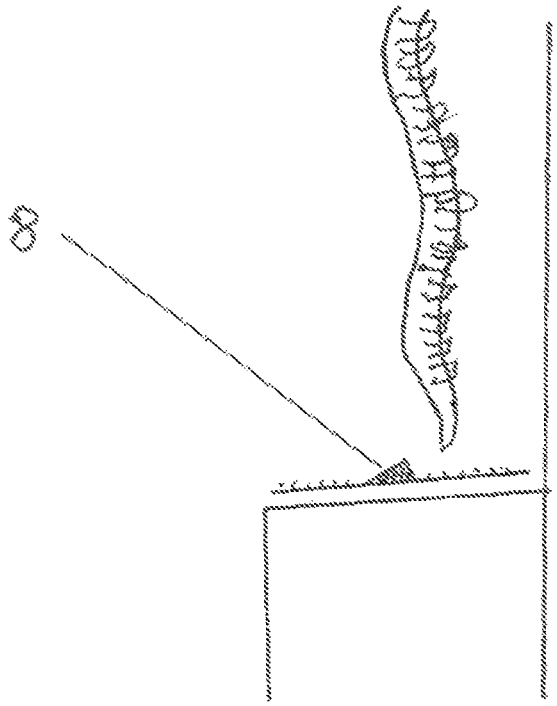
FIG. 5 is a diagrammatic representation of the vertebrae of a spine in relation to a chair provided with a mat as in FIG. 4.

The grip and posture mat 1 provided by the present invention may also comprise an upper posterior thigh strip 8, which is a raised ridge extending across all or a substantial part of the width of the mat 1, at a predetermined distance from a rear edge 1*c* thereof, and rearward of the centre of the focus area 3 as shown in FIG. 4. The thigh strip 8 may have a rounded or more triangular cross section as shown in FIG. 5 with, in this example, a maximum height of 0.7 cm and a width of 1.2 cm. It is obvious that these dimensions may be varied according to the size of the mat 1 and the end use thereof.

The thigh strip 8, as shown in FIGS. 4 and 5, will cause a subtle but noticeable compression for the buttocks of a user, specifically where the biceps femoris intercepts the ischium of the pelvic girdle. This acts as an almost unconscious prompt to the user to sit in the optimum location on the mat 1, so that the ischium is towards the rear of the mat 1 behind the thigh strips. It counteracts the tendency of many users to sit too far forward on a seat. Thus, the thigh strip 8 provides constant yet subtle neural feedback on the user's current position in relation to the mat 1.

Another embodiment of the mat 1 provided by the present invention is shown in FIGS. 6, 7, 8 and 9. This further comprises a spine riser 9 that has a rounded or bevelled rectangular cross section and extends across all or a substantial part of the width of the mat 1, rearward of the centre of the focus area 3. The spine riser 9 is a raised plateau, larger than the thigh strip 8, with a typical height of approximately 2.2 cm and a width of approximately 7.5 cm. Preferably the spine riser 9 itself includes a raised ridge acting as a thigh strip 8. The spine riser 9 addresses the intercept of the gluteus maximus with the ischium of the pelvic girdle but because it is larger than the thigh strip 8 it acts to slightly raise the pelvis and spine.

Figure 6:
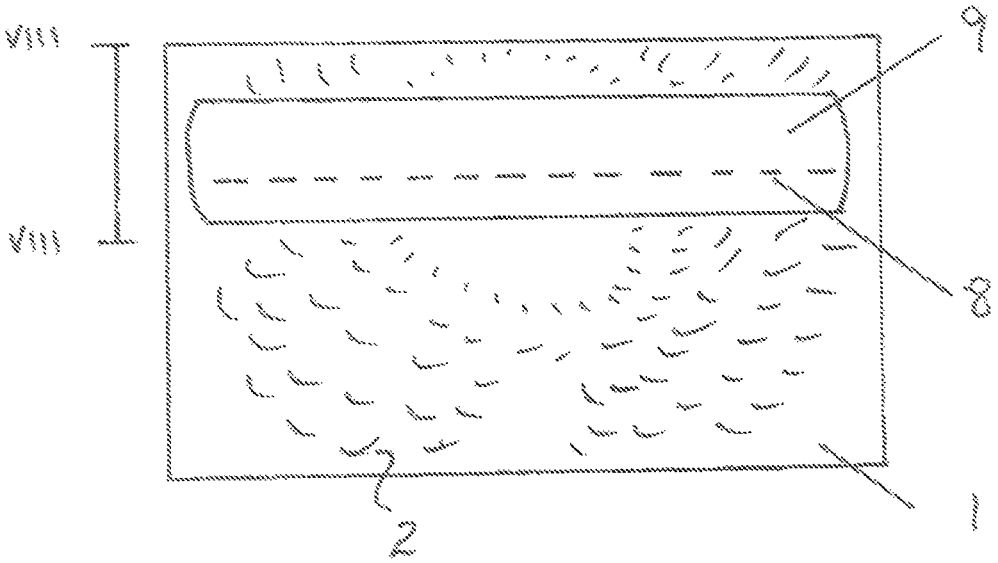
FIG. 6 shows a further embodiment of the present invention, which includes the addition of a spine riser and thigh strip.
Figure 7:
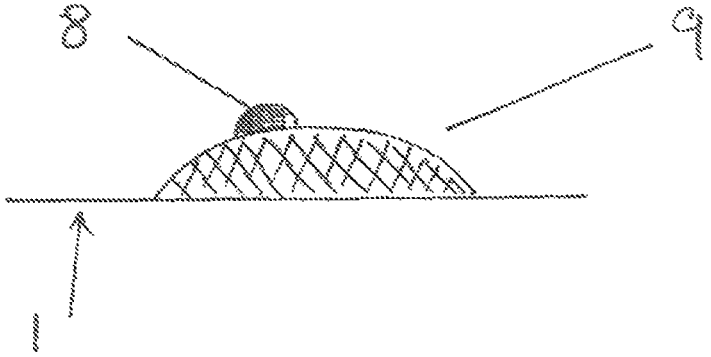
FIG. 7 shows a transverse section view of the spine riser and thigh strip taken along the line VIII-VIII of FIG. 6.
Figure 8:
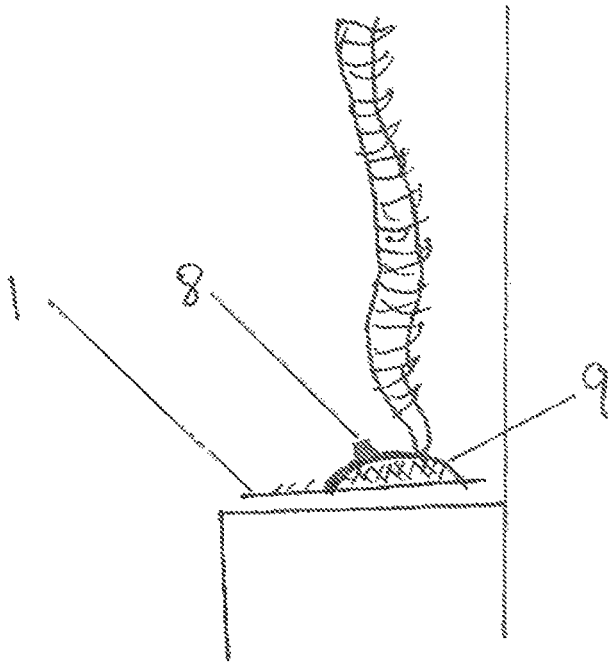
FIG. 8 is a diagrammatic representation of the vertebrae of a spine in relation to a chair provided with a mat as in FIG. 6.
Figure 9:
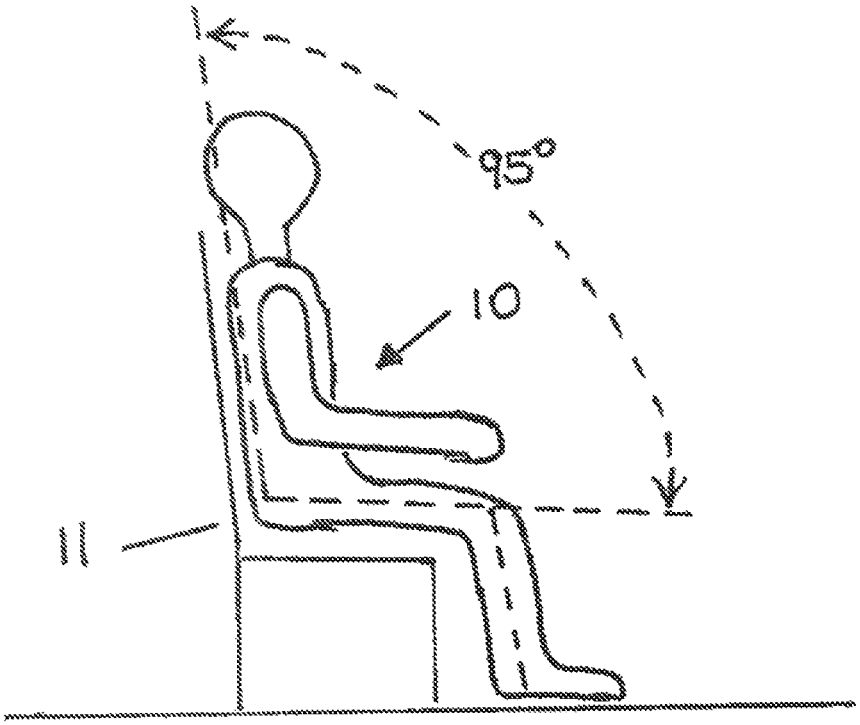
FIG. 9 is illustrative of a seated person in a correct posture position.

An example of the use of a mat 1 of FIG. 6 is illustrated diagrammatically in FIG. 9 where a user 10 is seated on a chair 11 to show that the raised spine will create an angle of about 95° between the thigh and the back, which is deemed by posture research studies to be the optimal incline angle in order to generate perfect posture and encourage the natural lordosis shape of the spine. The riser 9 uniquely addresses the upper posterior thigh, gluteus maximus muscles, to maintain and keep the gluteus muscles anchored to the optimal posture position in order to ensure that the spine achieves the optimal hip, knee relationship.

Since the spine riser 9 is typically a solid mass of polymeric material, the top of the spine riser 9 will preferably have a series of cushioning elements to prevent against undue discomfort for the ischial tuberosities. For example, these may be flagellum like, tapered antennae of up to 1 cm in height, 1 mm in circumference and with a density of up to 20 flagella per square centimeter. Another option is horizontal shaped convex strips that are up to 1 cm in height and have a space between each strip of 1 mm. These strips run the length of the spine riser 9, running front to back and perpendicular to the front edge of the mat 1. A further alternative is a herring bone design of raised convex strips that are up to 3 cm in length, 1 cm in height and with a 1 mm gap between each strip. It will be appreciated that any desired form of cushioning elements could be used.

The mat of the present invention is preferably an integrally moulded item which is cost-effective to manufacture. It is lightweight and flexible and can therefore be rolled up and carried about by a user, to be placed wherever the user wishes to sit down. However, the mat may also be permanently secured to, or integrally formed with, the seat of a chair, bench, stool or any other item intended to be sat upon. Thus, reference to a seating mat is intended to cover both a separate item and a seat incorporating the features of the present invention on the seating surface.

The present invention may also be incorporated into seats for specialist purposes, for example sports equipment such as bicycle saddles, rowing seats or equestrian saddles, and also in wheelchairs. A mat in accordance with the present invention could also be used as an item such as a baby changing mat to encourage a child to lie in a central position for increased safety and convenience.

It will be appreciated that variations and modifications are possible without departing from the scope of the claims. As noted above, the precise dimensions and form of the papillae 2, the focus area 3, the thigh strip 8 and the spine riser 9 can be altered as required.

In another aspect of the invention, it is also possible to provide a seating mat which does not feature the papillae 2, but includes simply spine riser, or a spine riser with a thigh strip. Such features function as above to encourage the user to sit at the correct position, towards the rear of the mat and, in the case of the spine riser, to raise the spine and achieve the optimum angle of the user's thigh to the seat. If desired, such a mat could also include a visual indication of the focus area to provide an initial visual trigger to the user to sit in the correct position, with sensory feedback from the thigh strip and/or spine riser then prompting further adjustment.

The invention claimed is:

1. A seating mat, comprising: an upper surface for supporting a user when seated and an array of flexible papillae extending from the upper surface and positioned around a focus area on the upper surface, wherein each papilla comprises a tapered projection having a longitudinal axis with a curvature such that at a tip end of each projection the longitudinal axis of the projection lies at an acute angle relative to the upper surface, and wherein the papillae are positioned such that all the tip ends of the papillae are directed towards the focus area.

2. A seating mat as claimed in claim 1, wherein the papillae are arranged in concentric circles around the focus area.

3. A seating mat as claimed in claim 1, wherein the array includes papillae of different sizes.

4. A seating mat as claimed in claim 3, wherein the papillae each have a height that varies in the range of 1 mm to 10 mm.

5. A seating mat as claimed in claim 1, wherein the papillae closest to the focus area are the smallest and their size increases in a direction away from the focus area.

6. A seating mat as claimed in claim 1, wherein a density of papillae in the array varies.

7. A seating mat as claimed in claim 6, wherein the density of papillae is in the range of 1.5 to 5 papillae per $cm^2$.

8. A seating mat as claimed in claim 1, wherein gaps are provided in the array of papillae to provide channels for air circulation.

9. A seating mat as claimed in claim 1, further comprising a raised ridge extending across the array and the focus area.

10. A seating mat as claimed in claim 1, further comprising a raised plateau extending across the array and the focus area.

11. A seating mat as claimed in claim 10, wherein the plateau further includes a raised ridge extending therealong.

12. A seating mat as claimed in claim 10, further comprising a plurality of cushioning elements formed on the raised plateau.

13. A seating mat as claimed in claim 1, wherein the mat is a separate item which can be placed onto an existing chair or other seating area.

14. A seating mat as claimed in claim 13, wherein a lower surface of the mat, opposed to the upper surface, is textured to increase grip when placed on a chair or other seating area.

15. A seating mat as claimed in claim 13, wherein the lower surface of the mat comprises projections or recesses or both configured to engage with corresponding recesses and/or projections on a chair or other seating area.

16. A chair, stool, bench or other seating area integral with the seating mat as claimed in claim 1.

* * * * *